US006201504B1

(12) United States Patent
Aminzadeh et al.

(10) Patent No.: US 6,201,504 B1
(45) Date of Patent: Mar. 13, 2001

(54) MOTOR VEHICLE BODY OF SYNTHETIC PLASTIC WITH ANTENNAS

(75) Inventors: Mehran Aminzadeh, Braunschweig; Ulrich Dieter Becker, Hildesheim; Reinhard Berfelde; Manfred Burkert, both of Bockenem; Michael Daginnus, Braunschweig; Andreas Schwarte, Holle; Wilhelm Probst, Bockenem, all of (DE)

(73) Assignee: FUBA Automotive GmbH, Bad Salzdetfurth (DE)

( * ) Notice: Subject to any disclaimer, the term of this patent is extended or adjusted under 35 U.S.C. 154(b) by 0 days.

(21) Appl. No.: 09/111,331

(22) Filed: Jul. 7, 1998

(30) Foreign Application Priority Data

Jul. 15, 1997 (DE) ..... 197 30 173

(51) Int. Cl.[7] ..... H01Q 1/32
(52) U.S. Cl. ..... 343/713; 343/711; 343/715
(58) Field of Search ..... 343/711, 712, 343/713, 714, 715, 716, 717

(56) References Cited

U.S. PATENT DOCUMENTS

| | | | |
|---|---|---|---|
| 4,737,795 | 4/1988 | Nagy et al. | 343/712 |
| 4,835,541 | 5/1989 | Johnson et al. | 343/713 |
| 5,355,144 * | 10/1994 | Walton et al. | 343/713 |

FOREIGN PATENT DOCUMENTS

| | | |
|---|---|---|
| 26 33 757 | 4/1977 | (DE) . |
| 38 08 401 A1 | 9/1989 | (DE) . |
| 93 03 435 U | 6/1993 | (DE) . |
| 195 35 250 A1 | 3/1997 | (DE) . |
| 61-277206 | 12/1986 | (JP) . |
| 63-76505 | 4/1988 | (JP) . |
| 63-124606 | 5/1988 | (JP) . |
| 6-152217 | 5/1994 | (JP) . |
| 6-152219 | 5/1994 | (JP) . |
| 08 21 38 35 | 8/1996 | (JP) . |
| WO 93/23890 | 11/1993 | (WO) . |

* cited by examiner

*Primary Examiner*—Don Wong
*Assistant Examiner*—Thuy Vinh Tran
(74) *Attorney, Agent, or Firm*—Michael J. Striker

(57) ABSTRACT

A vehicle body has a plurality of flat and rod-shaped synthetic plastic elements, and a plurality of antennas connected with the synthetic plastic elements for reception and transmission of various frequencies, the synthetic plastic elements at least partially being provided with surfaces and tracks of a differently thick metal coating, the metal coating being structured so that a selection of the antennas for identical or different frequencies and ground reference surfaces as well as regions with screening action are provided, and depending on an operational frequency and a required radiation diagram, radiations with various operational principals being produced, and the surfaces which act for one frequency as radiators for other frequencies belonging to a ground potential, the antennas and ground reference surfaces produced by a structuring as well the regions with screening action being distributed over synthetic plastic elements, the synthetic plastic elements for a predetermined antenna principle being metalized in two planes located one behind the other with a distance from one another which is operationally important for a corresponding operational principle.

28 Claims, 4 Drawing Sheets

MOTOR VEHICLE BODY OF SYNTHETIC PLASTIC WITH ANTENNAS

BACKGROUND OF THE INVENTION

The present invention relates to a motor vehicle in which the body at least in parts is not produced in a conventional way from sheets of metal or self-supporting metal sheet body.

Many parts or regions of the body as well as complete bodies are recently produced of synthetic plastic orframe constructions are provided with a covering of synthetic plastic. Synthetic plastics are also utilized as materials for motor vehicle window panes with corresponding finishing, surface treatment and coating.

Depending on the degree of the substitution of the conventional materials, completely new conditions and operations for the selection and design of antennas for reception and transmission operation and for their arrangement in the vehicle are provided. In addition, the number of the antennas for different objectives which must be installed on the vehicle increases. As a result, not a few new antennas with different frequency regions and radiation characteristics are integrated in the modern vehicle, in addition to the known systems.

The new premises for the antenna configuration result first of all from a changed influence of the electromagnetic fields, within which the vehicle is located or moves. The vehicle body has been formed as a parallelepiped of sheet metal. A part of the roof surface generally rests on bar-like elements or cross beams, while great, substantially rectangular openings or windows are located between them and closed with a dielectric material or glass pane. This construction is located closely over the great mass of the ground surface and is surrounded by an electromagnetic field caused from a plurality of sources, hereinbelow referred to as transmitters, whose signals must be received. Moreover, the vehicle can carry a transmitting radiator.

The metal part of the body and the dielectric of the panes leads to a characteristic deformation of the surrounding field and to different field concentrations around the vehicle and in the region of the window openings. From this field presently signals are uncoupled first of all with rod antennas and radiation structures in the window panes.

The metal body supports on the one hand the operation of the antennas as a wave type convertors and couple elements within predetermined regions, and on the other hand, supplies the metal surfaces of the required ground potential for the antennas.

When individual or all sheet metal surfaces of the vehicle are replaced by those composed of synthetic plastic, then the field formation and field concentration around the vehicle changes, and the ground potential, as the vehicle can be taken into consideration, fails or changes dramatically. As a result, the conditions for selection and arrangement of the antennas change or the predetermined configurations can not be used at all or can be used only conditionally.

Also, the introduction of window panes of synthetic plastic and of synthetic plastic/glass combination causes changes as well. With the new pane structure, metal-ceramic conductor tracks are applied with high temperature processes not in the same way as with conventional glass panes. Also, a use of such conductor tracks and substantially of inserted thin wires for heating purposes is questionable due to the required temperatures of the heating operation.

For the pane heating a following solution is provided:

The synthetic plastic pane is provided with a flat, electrically conductive metal coating which is connected to the direct current power supply. With a suitable arrangement of the heating current terminals, a uniform heating of the pane surface is provided without a high surface temperatures.

A window pane with a substantially closed metal coating and good electrical conductivity is however not suitable for the arrangement of wire and conductor track structure in the known manner and for its use as antenna radiator.

The problem of arranging of antennas relative to the body parts of synthetic plastic was addressed at an initial stage of the modern development in German patent application no. 195 35 250. The research which was conducted in connection with this application provided a series of patents which can give a good overview of the research and possibilities in this area. The proposed solutions were used for a transition from a conventional construction of the body and the design in steel sheets which is basically maintained. Only individual parts of the body were composed of non-metallic materials, and the antennas were applied on these parts. The antennas are arranged for example in and under the roof shells of synthetic plastic material, in a folding roof or a hard top of a cabriolet, in passenger space or motor hood and in shock absorbers.

These solutions, however on the one hand, are connected with the availability of the sheet metal body of the body of the vehicle and when the ground potential and the influence of the surrounding field is utilized. On the other hand, these factors act in disturbing manner for predetermined possible antennas and frequency regions.

SUMMARY OF THE INVENTION

Accordingly, it is an object of present invention to provide a motor vehicle body of synthetic plastic with antennas, which avoids the disadvantages of the prior art.

The present invention, in contrast to the known solutions, is derived from a condition that in an extreme case the above mentioned sheet metal parallelepiped with remaining individual metal parts of the drive aggregate and parts of the ground drive, components of dielectric material with eventually different $\epsilon_r$ surround the same, and the window panes which served before as supports for integrated antennas are no longer suitable or suitable only to a limited extent for this objective via an electrically conductive metal coating. It can be said that the field deformation due to the thusly formed structure can not be provided experimentally nor formed by calculations with reasonable expense.

It is expected that the usual and useful methods of the antenna configuration can not be utilized here.

It is the object of the present invention to find a principal solution and a way to provide with antennas a motor vehicle whose body is produced with partial or complete use of flat parts of synthetic plastic, as well as to optimize the operation of such antennas experimentally and by computations. The antennas are preferably selected with the consideration that they can be integrated in the vehicle construction and does not distort the shape flow of the body.

In keeping with these objects and with others which will become apparent hereinafter, one feature of present invention resides, briefly stated, in a motor vehicle body which is composed at least partially of flat and rod-shaped synthetic plastic elements, with the synthetic plastic elements connected with antennas for reception and transmittal of various frequencies, wherein in accordance with the invention the synthetic plastic elements are at least partially provided with surfaces and tracks of a differently thick, preferably electrically well conducting metal coating, the metal coating is structured so that on the one hand a number of antennas are provided for identical and different frequencies and on the other hand ground reference surfaces as well as regions with screening action are provided, wherein, depending on the operational frequency and required radiation diagram, radiators with different operational principals are provided, and the surfaces acting for one frequency as radiators belong to other frequencies for ground potential; the antennas and ground reference surfaces as well as the regions for screening action produced by the structuring are preferably distributed over the entire surface of the synthetic plastic elements; and the synthetic plastic elements for a predetermined antenna principle are metalized in two planes located one behind the other with a distances from one another which is operational for a corresponding operational frequency.

The invention does not deal with succinct reproduction of old solutions under new conditions, or in other words for example to produce a continuous metal coating on the synthetic plastic parts or a coating of a complete synthetic plastic coat of a quasi-metal sheet auto. To the contrary, the present invention utilizes a changed initial situation so as to provide the configuration of antennas on the vehicle body in a completely new way and to implement the objectives of the antenna integration in the vehicle construction efficiently with all consequences.

The whole vehicle is a complex antenna carrier and different radiators are arranged on and in it, there and in a way that they provide accordance with their operational principal the highest or optimal affect in a cost favorable manner. In contrast to the known state of the art, this means to provide a freedom for antenna design. For this purpose all types of flat antennas or antennas integrated in surfaces which are known to a person skilled in the art can be utilized, from conductor track structures similar to the window pane antennas and strip conductor antennas (patch antennas) through slot antennas up to flat radiators and monopoles and dipoles formed on the surfaces afterwards. Metalized surfaces which are located behind the radiator structures with corresponding functions can be arranged at different distances from the radiators located in front of them, depending on the conventional two-shell structure of the many body elements.

In addition to the functions as radiators and ground reference surfaces (grounding services) the metalization zone can be used for the purpose of screening by arranging and forming them in correspondence with the operational requirement.

Simultaneously, in the design of the simulation model, a possibility is provided to test all configurations and to measure under substantially realistic conditions and to optimize, based on the schematic structure of the model, also in the calculated simulation to comparably represent the same.

The simulation model makes possible for the antenna developer to provide a principal selection and the preliminary configuration of an antenna type independently from the readiness of the vehicle to be equipped with them and independently from the degree of the replacement of metallic parts by synthetic plastic parts.

In this manner, the problem is encountered that the antenna is considered by car manufacturers as an accessory, and the developer of the antennas has little time and no possibilities to provide an "antenna and reception-friendly environment" inside the vehicle construction or to test the novelties.

The inventive model makes possible not only a wide testing and utilization of the different antenna principles known to the expert in the field for new vehicle constructions, which is the initial point of the present invention. It also makes possible to equip conventional bodies afterwards for basic works such as for the optimization of the antenna systems.

The inventive structuring of the metalized surfaces of the body which can be defined by the stimulation model are no longer recognized on the synthetic plastic parts of a vehicle in a final condition. They disappear under the varnish when they are applied on outer surfaces, or are arranged in regions which are not visible depending on their operation.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1A:
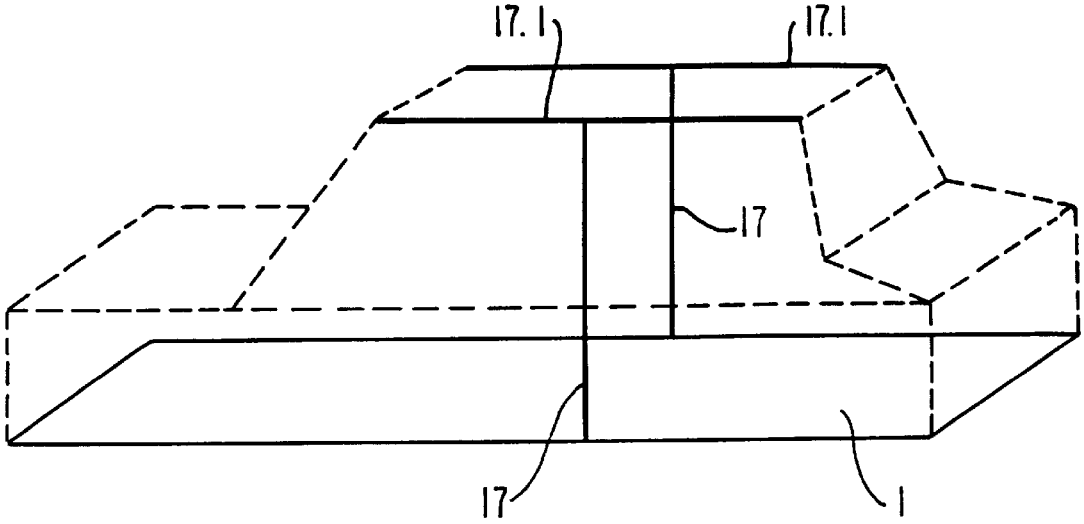
FIGS. 1*a* and 1*b* are views showing basic structures with a roof capacity with two radiators over a large-surface ground potential and two radiators over radials correspondingly.

In an example shown in FIG. 1*a* two vertical rods 17 with a roof capacity 17.1 are arranged laterally on a vehicle bottom plate 1 (ground plane). The vertical rods can be formed as metalizations of the B-cross beams or bars 3 (throughgoing central cross beam between the doors), and the roof capacity is produced by a metalization of the lateral roof cross beams. The bottom plate is composed of a metal sheet or of a throughgoing metalized material. The both radiators can be used as antennas for a radio reception in FM region (as $\lambda/4$ radiators) and in AM region.

Figure 1B:
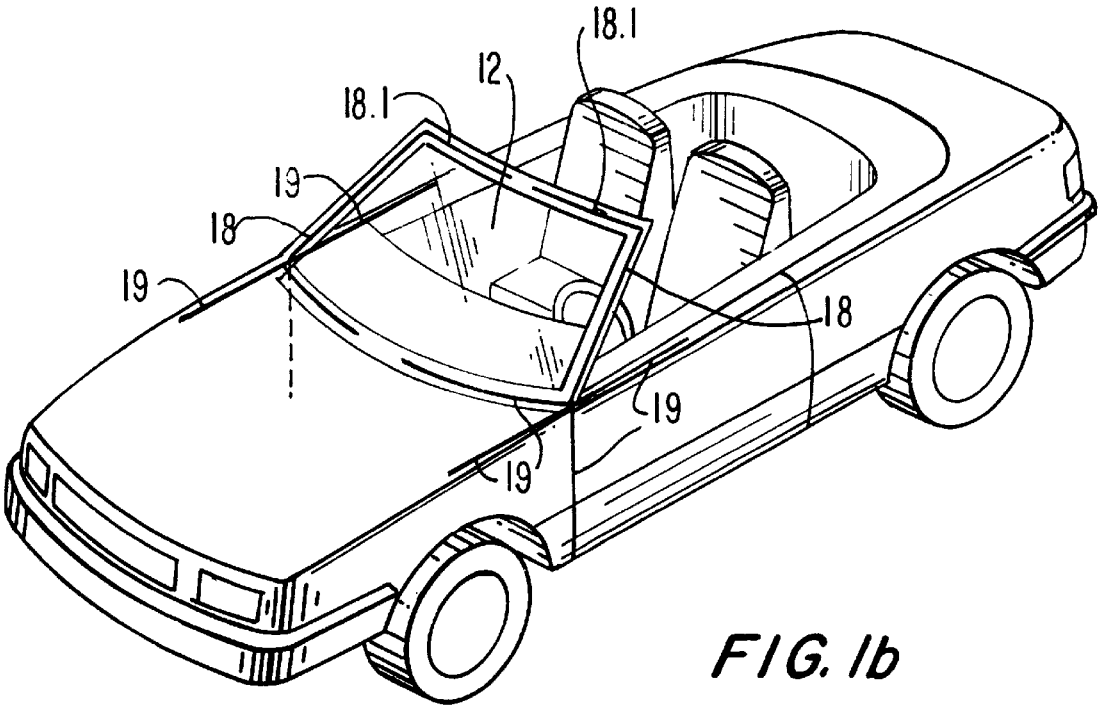

FIG. 1*b* shows two rod radiators 18 with a root capacity 18.1, which can be provided by metalization of the A-cross beam or bar and regional metalization of the roof cross beam over the front pane 12. The radials 19 are required as ground potential when the body coating is not metalized around the foot point of the antennas. The antennas are suitable for the radio reception in a cabriolet. It is recommended to form a rod or strip conductor type metalization as a vertical rod up to the bottom plate.

Figure 2A:
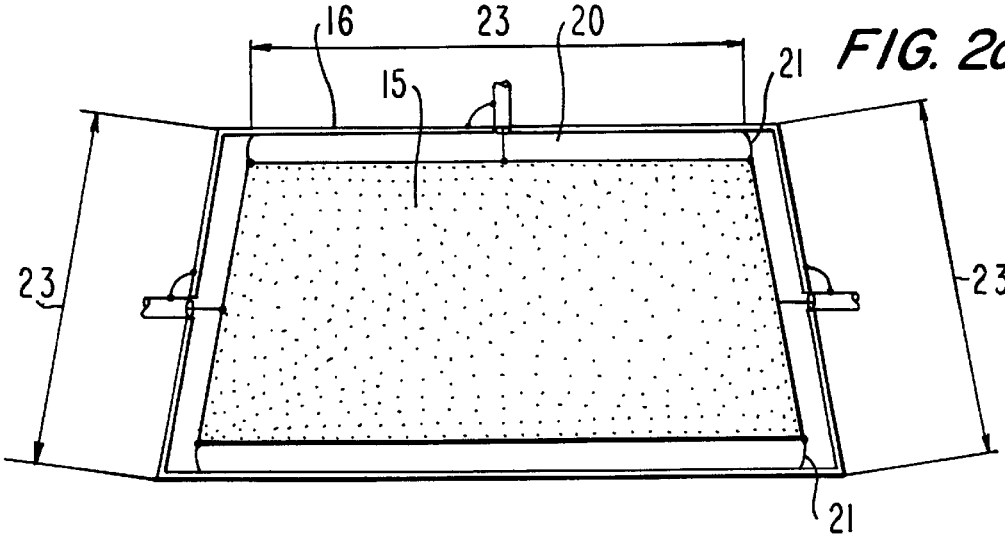
FIGS. 2*a*, 2*b* and 2*c* are views showing slot antennas in a window pane with a metal coating with high electrical conductivity.
Figure 2B:
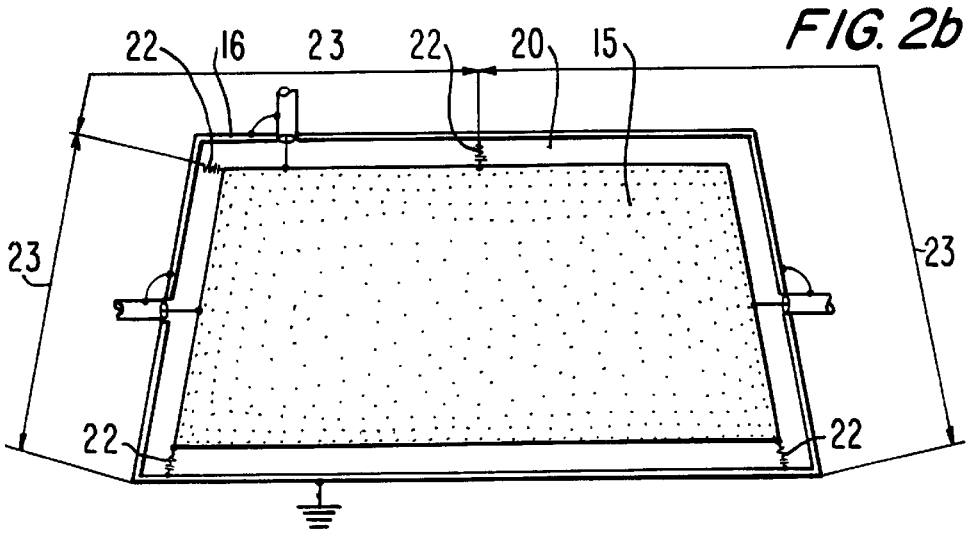
Figure 2C:
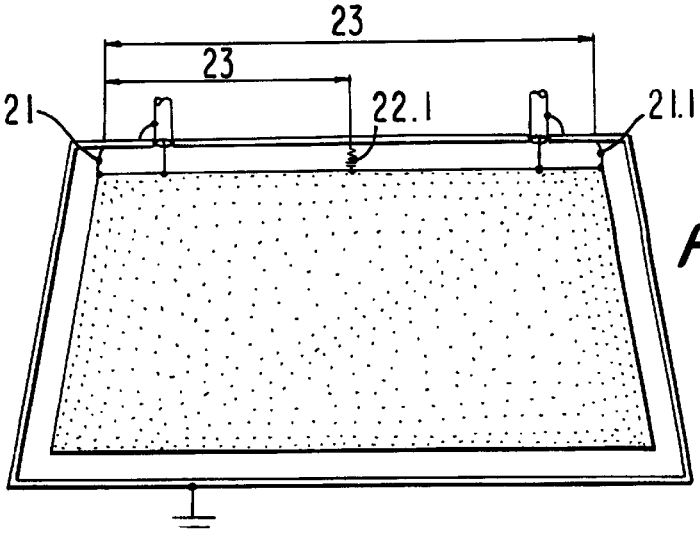

FIGS. 2*a*–2*c* are views showing antennas which are suitable for panes 12, 13 of synthetic plastic with a well conductive metal coating 15.

A flat, well conductive metal coating can be necessarily provided when for example a motor vehicle rear pane 13 composed of synthetic plastic or synthetic with a thin glass coating is to be heated. On this pane material the known conventional conductor structures can not be applied, since during sintering process such temperatures are required which are not compatible with the new pane constructions.

The metal coating 15 for the pane heating must be transparent, and however so tight and so well conductive that with a suitable connection to a heating current source it heats up sufficiently and uniformly.

The errors of the conventional conductor structure in the panes are make also noticeable with the configuration of antennas noticeable, since a metal coating with high electrical conductivity makes conventional window antennas substantially inefficient. In order to arrange antennas in the window region, a pane is used which is provided only in a visible region with a metal coating 15 and is surrounded by a metal frame or a metal-coated frame 16. A small free strip 20 is located around between the metalized region 15 and the frame 16. This strip in accordance with the present invention is used for the formation of slot antennas 23 for different frequencies.

For this purpose the slot length is defined by connection of HF-blocking means, for example short circuiting compounds 21 and series resonant circuit 22. In the examples the corresponding geometrical slot length is identified by the dimensional arrows.

As can be seen from the variants illustrated in FIGS. 2*a*–2*c*, the slot antennas can be formed with different lengths, which can be positioned near one another or another words in a row along the strip 20, and "overlappingly". The overlapping arrangement means that, starting from a common connection point 21, 22, different lengths to two other connecting points 21.1, 22.1 can be realized. The connecting point 21.1, 22.1, which is the closest to the initial point, is dimensioned electrically so that it is blocking for the higher of the both frequencies and permeable for the lower one. For the lower frequency the connecting point acts blockingly with a great distance. An interesting use of this principle resides in the fact that a slot can be composed from a horizontal branch and, extending over the corner, a lateral cross beam-parallel branch. Therefore favorable fields with horizontal and vertical polarization components are received.

Figure 3A:
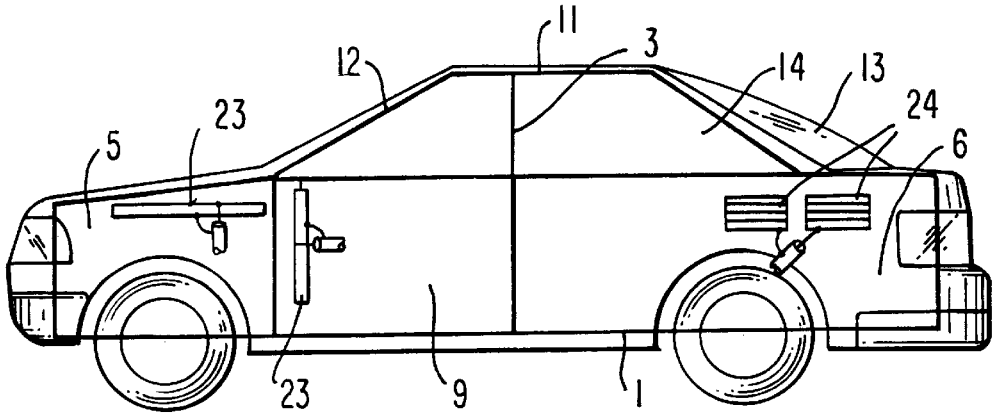
FIGS. 3*a*, 3*b*, 3*c* are views showing antennas on parts of a body coating, in particular on two fenders and one door, on the door, on the closed roof, correspondingly.
Figure 3B:
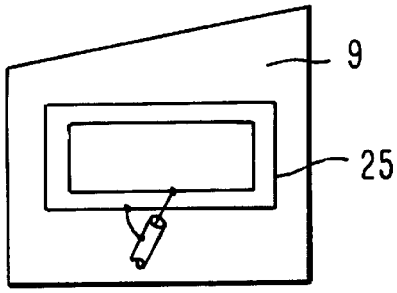
Figure 3C:
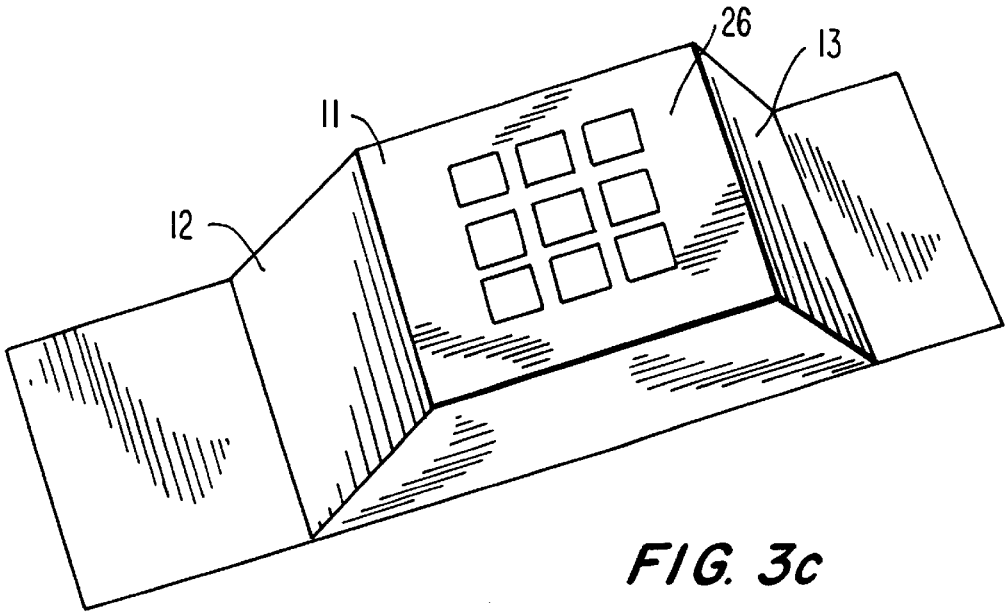
Figure 4A:
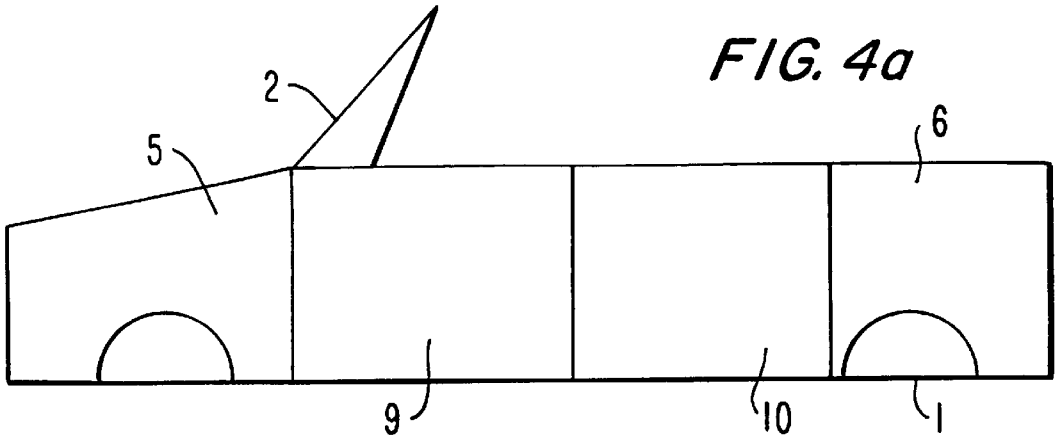
FIGS. 4*a* thru 4*d* are views showing simulation models for roof formations of various types, in particular a base body and different roof parts correspondingly.
Figure 4B:
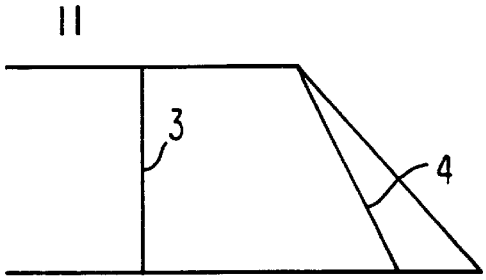
Figure 4C:
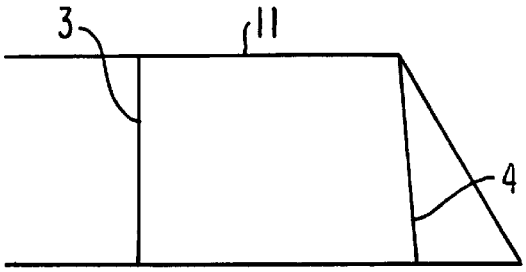
Figure 4D:
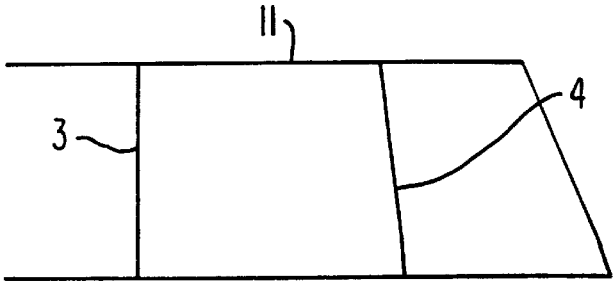

FIGS. 3*a*–3*c* show antenna constructions with the use of larger surfaces of the body. The both slots 23 of FIG. 3*a* in the fender 5 and in the door 9 can be supplied asymmetrically for placing the input impedance in a low-ohmic region.

With the arrangement at the right angle, also the reception of signal components of different polarizations or, with a face-correct coupling, the reception of circular polarization is possible. The slots are realized so that the surrounding surfaces are continuously metalized, or they are formed as skeletized slots of strip conductor tracks.

In the rear fender 6 in the shown example additionally a so-called thick half wave dipole 24 for linear polarization is provided. The folded slot radiator 25 in the door in accordance with FIG. 3*b* also provides for this slot construction a characteristic relatively low input impedance.

FIG. 3*c* shows a strip conductor-group antenna (path array) 26 in the roof 11 of a vehicle. It is suitable for satellite reception in GHz region. The required ground potential can be provided with a required distance in the radiation direction, in the design of a metalization of the roof inner covering.

From different exemplary illustrations for the radiation principle suitable for the invention the following can be derived:

on substantially horizontal zones of the body, first of all antennas with round radiation (for terrestrial operation) and such with upwardly directed lobe for example for satellite reception are arranged, and in substantially vertical zones of the body predominantly antennas with a transverse radiation are provided, wherein here, when required, quasi-round radiation is produced, with several identical antennas for a frequency region arranged at all sides of the vehicle, and the signals are summarized or combined to a multi antenna arrangement with space diversity.

FIG. 4 shows an inventive simulation model of a vehicle. It is composed for example of a rod system which is covered when desired. The cover depending on the requirements, can be partially to completely metalized or provided with inventive structured metal surfaces. The model is subdivided for example into a base body and variable adjoining mounting elements. The base body is composed in a preferable embodiment of a bottom plate 1 and a rod system up to the height of the flange line with the addition of the A cross-beam with the roof-side flanging of the front pane region. Doors, a motor hood and a trunk cover are connected articulately. Reference numeral 2 identifies a windshield.

The parts for the roof 11 as well as B and C cross beams 3, 4 are joined modularly as mounting parts and are exchangeable. Therefore selectively a cabriolet or limousine with a stepped rear and with a continuous rear and a caravan-like construction can be obtained. Since on the model only the roof 11 varies as to its dimension, therefore with low expenses changes and completions can be provided.

The rod network principle also provides favorable conditions for the realization of double-shell covering parts. Thus, in a simple manner it is possible to imitate the actual conditions on the vehicle. Simultaneously, the formation of metalization surfaces with different functions and with different distances from one another is supported. The covering parts are produced from different suitable synthetic plastics, for realistically reproducing the conditions of the practice, for example with respect to different relative dielectricity constants.

As for the treatment of HF interferences which are produced by a vehicle electronic system and the like, comparative conditions can be obtained in the simulation model and a vehicle with partial or continuous use of synthetic plastic elements, for which purpose at least the motor space of the vehicle is screened against the remaining vehicle regions, for example substantially incapsulated.

It will be understood that each of the elements described above, or two or more together, may also find a useful application in other types of constructions differing from the types described above.

While the invention has been illustrated and described as embodied in motor vehicle body of synthetic plastic with antennas, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A vehicle body, comprising a plurality of flat and rod-shaped exclusively synthetic plastic elements; and a plurality of antennas connected with said synthetic plastic elements for reception and transmission of various frequencies, said synthetic plastic elements at least partially being provided with surfaces and tracks of a differently thick metal coating, said metal coating being structured so that a selection of said antennas for identical or different frequencies and ground reference surfaces as well as screening regions are provided, and required radiations are produced, and the surfaces which act for one frequency as radiators for other frequencies belonging to a ground potential, said antennas and ground reference surfaces being produced by a structuring as well said screening regions being distributed over synthetic plastic elements, said synthetic plastic elements being metalized in two planes located one behind the other with a distance from one another which corresponds to a required operational frequency.

2. The vehicle body as defined in claim 1, wherein said metal coating is composed of an electrically conductive material.

3. The vehicle body as defined in claim 1, wherein said antennas, said ground reference surfaces and said screening regions with are distributed over a whole surface of said synthetic plastic elements.

4. The vehicle body as defined in claim 1; and further comprising conductive regions and non-conductive and poorly conductive regions which separate said conductive regions from one another, corresponding widths of said regions being selected so that they act separatingly for predetermined high frequencies and are non-recognizable for relatively lower frequencies.

5. The vehicle body as defined in claim 4, wherein said non-conductive and said weakly conductive regions are strip shaped.

6. The vehicle body as defined in claim 1, wherein some of said antennas with directional characteristics are arranged around on surfaces of the body and a round characteristic is produced by phase-directional connection of signals in form of a summing diagram.

7. The vehicle body as defined in claim 6, wherein said antennas with directional characteristics are arranged on vertical surfaces of said body.

8. The vehicle body as defined in claim 1, wherein some of said antennas with directional characteristics are arranged around on surfaces of said body and form a multi-antenna arrangement for an antenna diversity.

9. The vehicle body as defined in claim 8, wherein said antennas with directional characteristics are arranged on vertical surfaces of said body.

10. The vehicle body as defined in claim 8; and further comprising window panes composed of a material selected from the group consisting of synthetic plastic and synthetic plastic/glass combination with an electrically well conductive metalization which is optically transparent, said metalization being surrounded by a non-conducting flanging with such a width that said metalization acts for predetermined frequencies as a separate surface which is useable as an antenna.

11. The vehicle body as defined in claim 1; and further comprising window panes composed of a material selected from the group consisting of plastic and plastic-glass combination with a well conductive metalization which is optically transparent, said metalization being surrounded by a non-conductive flanging in which slot antennas are formed.

12. The vehicle body as defined in claim 11, wherein said metalization is surrounded by said non-conductive flanging around said metalization.

13. The vehicle body as defined in claim 1, wherein said body is composed at least partially of frame parts provided with a coating of synthetic plastic, said antennas being integrated in said synthetic plastic coating.

14. The vehicle body as defined in claim 13, wherein said body is composed predominantly of said frame parts.

15. The vehicle body as defined in claim 13, wherein said frame parts are completely provided with said coating.

16. The vehicle body as defined in claim 13, wherein said frame parts are composed of metal.

17. The vehicle body as defined in claim 13, wherein said frame parts are composed of a dielectric material.

18. A device for experimental selection, positioning and dimensioning of antennas on synthetic plastic elements of a vehicle body, comprising a device structure composed of a dielectric material and forming contours and dimensions of a vehicle, said device structure including a bottom plate with at least partially variable rod network arranged on said bottom plate to form a limousine in different variants, said device structure having flat parts which are subdivided into sections mounted in correspondence with a vehicle type to be imitated on elements of said rod network; and antenna structures and ground surfaces provided on parts of said rod network and on said flat parts by applied foils and metallic covering layers.

19. The device as defined in claim 18, wherein said flat parts are plane.

20. The device as defined in claim 18, wherein said device structure has a base body which imitates a vehicle up to a flange line including an A cross beam with flanging of a front pane, and different roof elements for simulation of different vehicle types.

21. A vehicle body, comprising a plurality of flat and rod-shaped exclusively synthetic plastic elements; and a plurality of antennas connected with said synthetic plastic elements for reception and transmission of various frequencies, said synthetic plastic elements at least partially being provided with surfaces and tracks of a differently thick metal coating, said metal coating being structured so that a selection of said antennas for identical or different frequencies and ground reference surfaces as well as screening regions are provided, and required radiations are produced, and the surfaces which act for one frequency as radiators for other frequencies belonging to a ground potential, said antennas and ground reference surfaces being produced by a structuring as well said screening regions being distributed over synthetic plastic elements, said synthetic plastic elements being metalized in two planes located one behind the other with a distance from one another which corresponds to a required operational frequency, said antennas including rod antennas which are integrated in rod-shaped elements of said body and provided with roof capacities.

22. The vehicle body as defined in claim 21, wherein said rod-shaped antennas are integrated in A cross-bars and B cross-bars.

23. A vehicle, comprising a vehicle body which is composed as a whole of synthetic plastic and has body parts composed of the synthetic plastic and provided with metallic, electrically conductive coatings; and at least one antenna arranged on said vehicle body and having electrically active parts, all electrically acting parts of said antenna being formed by said metallic, electrically conductive coatings of said plastic body parts of said vehicle body which is composed as a whole of the synthetic plastic.

24. The vehicle as defined in claim 23, wherein said electrically active antenna parts include an antenna body.

25. The vehicle as defined in claim 23, wherein said electrically active antenna parts include a ground reference surface.

26. The vehicle as defined in claim 23, wherein said electrically active parts of said at least one antenna include an electromagnetic screen.

27. The vehicle as defined in claim 23, wherein said at least one antenna is a slot antenna.

28. The vehicle as defined in claim 27, wherein said slot antenna has a slot which forms a closed curve.

* * * * *